US006516476B1

(12) United States Patent
Thums

(10) Patent No.: US 6,516,476 B1
(45) Date of Patent: Feb. 11, 2003

(54) TUB SURROUND PRODUCT AND RELATED METHODS OF DESIGN

(76) Inventor: Dennis Thums, 7250 N. Beach Dr., Fox Point, WI (US) 53217-3659

( * ) Notice: Subject to any disclaimer, the term of this patent is extended or adjusted under 35 U.S.C. 154(b) by 0 days.

(21) Appl. No.: 09/689,134

(22) Filed: Oct. 12, 2000

(51) Int. Cl.[7] ..... A47K 3/02; A47K 3/16

(52) U.S. Cl. ..... 4/584; 52/35; 52/742.1; D23/305

(58) Field of Search ..... 4/584, 614, 538, 4/546, 548, 559; 52/35, 742.1, 390–392; D23/305

(56) References Cited

U.S. PATENT DOCUMENTS 3,605,352 A * 9/1971 Ruggles et al. ..... 52/35
D274,458 S * 6/1984 Doman ..... D23/305
4,817,344 A * 4/1989 Wissinger ..... 52/35
5,263,294 A * 11/1993 Koenig et al. ..... 52/35 X
5,303,519 A * 4/1994 Mustee et al. ..... 52/35
6,161,353 A * 12/2000 Negola et al. ..... 52/453

* cited by examiner

*Primary Examiner*—Timothy L. Maust
*Assistant Examiner*—Kathleen J. Prunner
(74) *Attorney, Agent, or Firm*—Reinhart Boerner van Deuren, S.C.

(57) ABSTRACT

A bathtub wall unit includes a single sheet having at least one frame member integrated therewith defining an interior portion for superimposition of one or more wall components thereon. Such units can be assembled to provide a method of using a wall unit to enhance the aesthetics associated therewith.

11 Claims, 2 Drawing Sheets

TUB SURROUND PRODUCT AND RELATED METHODS OF DESIGN

BACKGROUND OF THE INVENTION

This invention relates generally to a wall panel unit, such as for use in a bathroom or other area where the appearance of tiled walls is appropriate and, more particularly, to such wall panel units for use as tub surrounds.

It is well known in the art to provide tiled walled units in bathrooms, such walls and appearance having garnered wide appeal. Commonly, such tiles are square or have another regular polygonal shape with indented recesses therebetween to simulate grout lines between adjacent tiles. The concept of bathroom tub surrounds is also known, as evidence by U.S. Pat. Nos. 4,067,071, 4,328,552, 4,671,026 and 4,817,344. Each describes, however, a tub surround product which includes large flat areas not generating the same appeal as provided by a tiled appearance. While individual decals have been provided to decorate such areas, ambient bathroom moisture and related considerations limit practical usefulness. The same problems persist with wallpaper applications, not to mention such treatments can cover the simulated grout lines.

The search for an efficient, practical and attractive bathroom and/or tub surround product meeting these and other requirements has been an ongoing concern in the art. In addition, the recent boom in home remodeling has fostered a particular desire to afford the ability to customize a standard construction product. As such, there is a demonstrated need for an improved bathroom and/or tub surround product addressing the considerable number of problems and deficiencies current to the art.

SUMMARY OF THE INVENTION

In light of the foregoing, it is an object of the present invention to provide a bathroom and/or tub surround product thereby overcoming various deficiencies and shortcomings of the prior art, including those outlined above. In a related aspect, it can be a further object of the present invention to provide related methods for the customized, decorative design of such products.

It would be understood by those skilled in the art that one or more aspects of this invention can meet certain objectives, while one or more other aspects can meet certain other objectives. Each objective may not apply equally, in all its respects, to every aspect of this invention. As such, the following objects can be viewed in the alternative with respect to any one aspect of this invention.

It can also be an object of this invention to provide a bathroom and/or tub surround product having a customized or personalized design identity such that the custom or personal design components also function effectively under ambient use conditions. In particular, it can also be an object of this invention to provide such components which can be as impervious to moisture as is the product itself, such that incorporation therein does not compromise functional practicality.

Other objects, features, benefits and advantages of the present invention will be apparent from this summary and its descriptions of various preferred embodiments, and will be readily apparent to those skilled in the art having knowledge of various bathroom or bathtub products and/or methods of use. Such objects, features, benefits and advantages will be apparent from the above as taken in conjunction with the following figures and all reasonable inferences to be drawn therefrom, alone or with consideration of the claims which follow.

In part, the present invention relates to a bathroom and/or bathtub wall unit including a single sheet of material having opposed surfaces and one end directed upward. The sheet includes at least one frame member integral with and/or positioned on a surface of the sheet, with the frame including a peripheral edge extending therefrom. Preferred embodiments include a plurality of frame members arranged and configured in a predetermined pattern. In highly preferred embodiments, multiple frame members are positioned downward from the uppermost end of the sheet material and can be arranged in a symmetrical or geometric pattern. Regardless, various preferred embodiments of this invention include at least one frame member which defines a horizontally oriented, substantially rectangular portion along the upper end of the sheet material. In various such embodiments, the aforementioned portion extends substantially the width of the sheet.

As mentioned above, two or more frame members can be positioned somewhat below the upward end of the sheet material of this invention. With reference to the aforementioned framed rectangular portion, such frame members can be positioned therebelow and/or symmetrically on the sheet material, thereby providing for a variety of design appearances. Preferably, such frame members define a polygonal portion of the sheet; however, non-polygonal portions can also be defined in accordance with this invention.

Irrespective of the aforementioned frames or sheet portions defined thereby, various panels or wall units of this invention can include a plurality of integral shapes configured on the sheet surface to provide an additional design or ornamental effect. Preferably, and consistent with traditional bathroom configurations, such shapes can, but are not required to be, polygonal and are adjacent one to another with surface recesses therebetween. In such a manner, the adjacent integral shape and recess combination can provide a simulated tile and grout appearance.

In one aspect of this invention, one or more of the aforementioned frame members can be dimensioned substantially as the integral shapes configured directly on the sheet surface, such that the frames are positioned to coincide with one or more recesses. Regardless, a plurality of such sheets and/or wall units can be configured for cooperation with one another to provide an assembly having a tiled appearance. Such an assembly can further include various corner molding or such other trim components for additional structural or aesthetic benefit. In the home use context, three such units can be assembled to provide a tub surround or stall having a tiled wall appearance.

In part, the present invention can also be a method of using a wall unit to enhance the aesthetics associated with bathroom and/or bathtub design. Such a method includes (1) providing a wall unit comprising a single sheet material having opposed surfaces and one end directed upward, the sheet including at least one frame member integral with and positioned on a surface of the sheet, with the frame member including a peripheral edge extending from the sheet; and (2) positioning within each frame at least one wall component. Configured as described, the sheet has a separate, first appearance, but a second different appearance upon positioning a wall component within a frame member. The second, different appearance can be further effected by the number of wall components within each frame member. Various embodiments of this invention provide for a single component positioned within each frame, but a plurality of wall components within each frame can also be used to differentiate the sheet appearance.

The sheet material used on conjunction with a method of this invention can be arranged and configured as more fully described above. In particular, integral frame members can define a rectangular portion along the upper end thereof and/or one or more portions positioned there below in a geometrical and/or substantially symmetrical pattern. The integral frames can be used in conjunction with shapes configured on the sheet surface, such shapes as can be polygonal, adjacent one to another and having recesses therebetween to provide the appearance of individual tiles joined by grout. The differentiated appearance of such a sheet can be effected by frame member dimensions and the number of wall components positioned therein.

The sheet components of this invention can be prepared using materials and/or processes well-known to those skilled in the art of bathroom and/or bathtub fixtures. Such components can, however, be thermoformed using suitable plastic materials, with the pattern of integral frames predetermined according to mold structure and configuration. Various other structural components can be provided in conjunction with such a sheet, such components including, but not limited to, towel holders or bars and shelving units, the later optionally configured for water drainage while supporting soap or shampoo containers.

The wall components of this invention can be any suitable decorative and/or ceramic tile. In preferred embodiments, the integral sheet frames are dimensioned to receive standard-sized tiles or combinations thereof. Such tiles can be purchased in conjunction with, or separately from, the sheets or wall units described herein providing the home owner or installer the opportunity to customize a bathroom fixture corresponding to personal taste in decor. The units, sheets and/or assemblies of this invention are available through Design House, Inc. of Germantown, Wis.

BRIEF DESCRIPTION OF PREFERRED EMBODIMENTS

Figure 1:
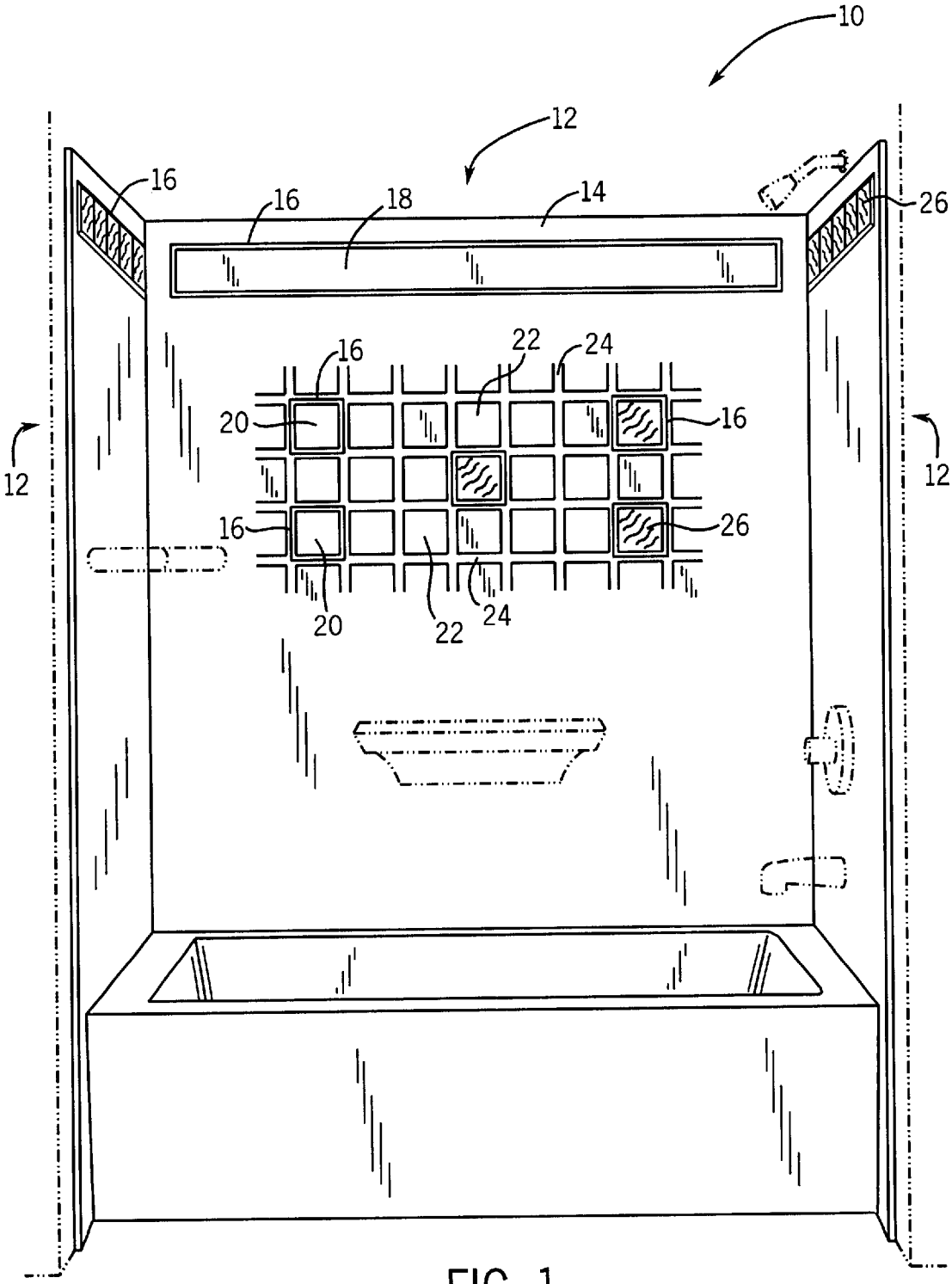
FIG. 1 is a perspective view of a wall unit assembly, in accordance with this invention, showing a plurality of sheets configured to provide a bathtub stall.

As best seen in FIG. 1, a typical bathtub fixture can be surrounded by assembly 10 comprising a plurality of wall units 12. Three such wall units configured as shown in FIG. 1 provide assembly 10 commercially known as a tub surround. Each wall unit 12 can include a number of structural components including unitary sheet 14, shelving and support bars. Each such sheet can include one or more frame members 16 positioned about sheet 14, each said member including a peripheral edge extending from sheet 14.

With continued reference to FIG. 1, preferred embodiments of this invention can include sheet 14 with frame member 16 defining a horizontally oriented, substantially rectangular portion 18 along an upper end of sheet 14. Additional frame members 16 can be positioned a distance from rectangular portion 18, such separate frames defining corresponding portions 20. In preferred embodiments, each such portion 20 has a polygonal shape, but other configurations can be defined on sheet 14 consistent with the broader aspects of this invention. Irrespective of the portions defined thereby, one or more frame members 16 can be positioned on and/or integrated with sheet 14 to provide a variety of designs.

Figure 2:
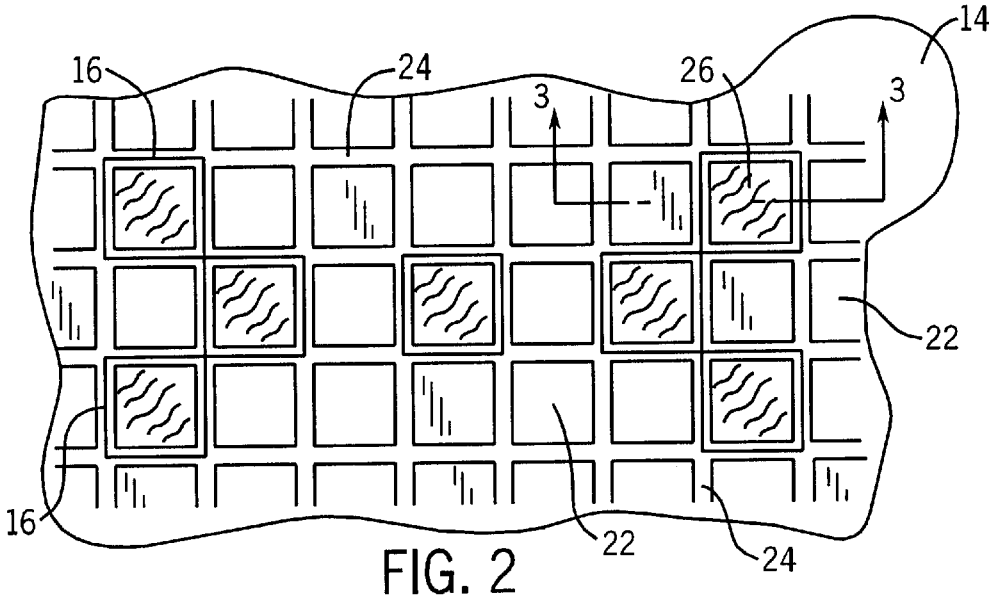
FIG. 2 is an enlarged fragmentary top view of a sheet having, in accordance with this invention, a simulated tile and grout appearance.

With reference to FIG. 2, a preferred embodiment of sheet 14 further includes a plurality of integral shapes 22 configured thereon to provide an additional design or ornamental effect. Preferably, such shapes 22 are polygonal and adjacent one to another with recesses 24 therebetween to provide sheet 14 a simulated tile/grout appearance. Such embodiments can further include, as shown in both FIGS. 1 and 2, one or more frame members 16 positioned cooperatively with recesses 24. Superimposition of wall components 26 on framed portions 18 and/or 20 enhances the aesthetic effect and related design methods available through this invention. As evident in the enlarged view provided by FIG. 2, placement of frame members 16 and recesses 24 can align wall components 26 with configured portions 22 to provide a coordinated tile and grout appearance.

Figure 3:
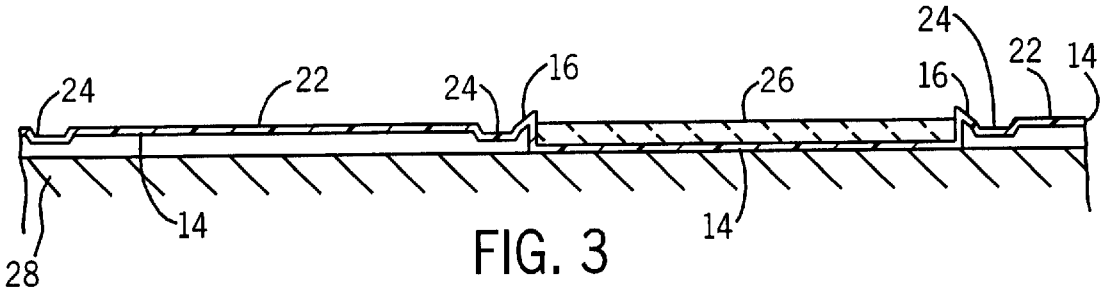
FIG. 3 is a partial cross-sectional view of a fragment of FIG. 2 taken along line 3—3 thereof.

Other aspects of wall unit 12 are illustrated by the cross-sectional view of FIG. 3. Sheet 14 is positioned on substrate 28 which can be of wall board construction. As seen in FIG. 3, the peripheral edge of frame member 16 extends from sheet 14 such that wall component 26 is positioned therein. Integrated shape portions 22 can be substantially co-planar with wall components 26. Regardless, recess 24 and frame member 16 are preferably arranged and configured to provide, with wall component 26, a uniform tile/grout appearance on sheet 14.

Figure 4:
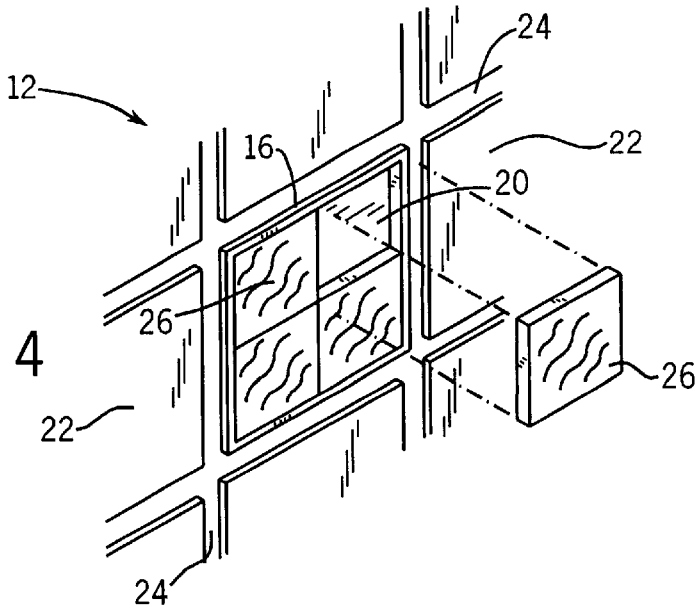
FIG. 4 is an enlarged fragmentary partial-exploded perspective view of a frame with wall components positioned therein.

While described above, various aspects and features relating to the method(s) of this invention can be understood in view of FIG. 4. One or more wall components 26 can be super-imposed on framed portion 20 (or portion 18) and secured thereto with a suitable adhesive material. In accordance with this invention, preferred wall components 26 are tiles constructed from one of a number of suitable materials. Such components and a suitable adhesive are commercially available from a wide variety of retail outlets, as would be known to those skilled in the art of home construction and/or remodeling. The tiles/components are typically standard 4.25 inch squares; however, various other sizes are available such that a number of tiles/components can be used one with another to provide substantially the same surface area and configuration. In a similar fashion, one or more tiles/wall components 26 can be superimposed on rectangular portion 18 to provide, as seen in FIG. 1, a corresponding design or ornamental feature along an edge of sheet 14, such an appearance different from and enhancing the appearance and aesthetics of sheet 14.

As discussed above, the configuration and placement of frame members 16 and/or in conjunction with a simulated tile/grout appearance on sheet 14 can provide, together with choice of wall components 26, a near infinite number of sheet, wall unit and/or assembly designs. For example, an embodiment of the invention illustrated in FIG. 1 can, alone, provide a wide variety of design appearances solely by choice of tile/wall components 26. As such, the method(s) of this invention and the associated sheet, wall unit and/or assemblies thereof are limited only by personal taste in decor.

While the principles of this invention have been described in connection with the specific embodiments, it should be understood further that the descriptions, along with the chosen figures, are made only by way of example and are not intended to limit the scope of this invention in any manner. For example, various structural components can be integrated into the sheets of this invention to provide the desired functional effect. Likewise, it is contemplated that this invention can also embody a kit including a sufficient number of sheets, tiles/wall components and adhesive materials necessary to provide a complete tub surround assembly. Other advantages and features of this invention will become apparent from the claims made thereto, with the scope thereof determined by the reasonable equivalents, as would be understood by those skilled in the art.

What is claimed:

1. A bathtub wall unit comprising a single sheet having opposed surfaces and an end directed upward, said sheet including a plurality of frame members on said sheet, said frame members being arranged and configured in a predetermined pattern wherein at least one of said frame members defines a horizontally oriented substantially rectangular portion of one of said opposed surfaces along said upward end extending substantially the width dimension of said sheet and wherein at least two of said frame members are positioned downward from said defined substantially rectangular portion, said frame members being positioned symmetrically on said sheet, said frame members being integral with and positioned on one of said opposed surfaces and comprising a peripheral edge extending from said one of said opposed surfaces.

2. The wall unit of claim 1 wherein each said frame member defines a polygonal portion of said sheet.

3. A bathtub wall unit comprising a single sheet having opposed surfaces and an end directed upward, said sheet including at least one frame member integral with and positioned on one of said opposed surfaces, said frame member comprising a peripheral edge extending from said one of said opposed surfaces, and said sheet further including a plurality of integral polygonal shapes configured on said one of said opposed surfaces, each of said shapes being adjacent to one another and having a surface recess therebetween.

4. The wall unit of claim 3 wherein one frame member defines a horizontally oriented substantially rectangular portion of said one of said opposed surfaces along said upward end.

5. The wall unit of claim 3 wherein at least two frame members are positioned symmetrically on said one of said opposed surfaces, each said frame member defining a polygonal portion of said sheet.

6. The wall unit of claim 5 wherein each said polygonal portion has substantially the same dimensions as said polygonal shapes.

7. The wall unit of claim 5 wherein said sheet is configured for cooperation with a plurality of other sheets, said plurality of sheets comprising an assembly having a tiled appearance.

8. A method of using a wall unit to enhance bathtub aesthetics, said method comprising:

providing a bathtub wall unit comprising a single sheet material having opposed surfaces and an end directed upward, said sheet including a plurality of frame members arranged and configured in a predetermined pattern wherein at least one of said frame members defines a horizontally oriented substantially rectangular portion of one of said opposed surfaces along said upward end and wherein at least two of said frame members are positioned downward from said defined substantially rectangular portion, said frame members being positioned symmetrically on said sheet, said frame members being integral with and positioned on one of said opposed surfaces and comprising a peripheral edge extending from said one of said opposed surfaces, said sheet having an appearance; and positioning within each said frame member at least one wall component, with a plurality of wall components being positioned within at least one frame member, each said wall component having an appearance different from said sheet appearance.

9. A method of using a wall unit to enhance bathtub aesthetics, said method comprising:

providing a bathtub wall unit comprising a single sheet material having opposed surfaces and an end directed upward, said sheet including at least one frame member integral with and positioned on one of said opposed surfaces, said frame member comprising a peripheral edge extending from said one of said opposed surfaces, said sheet further including a plurality of integral polygonal shapes configured on said one of said opposed surfaces, each of said shapes being adjacent one another and having a surface recess therebetween, said sheet having an appearance; and positioning within each frame member at least one wall component, each wall component having an appearance different from said sheet appearance.

10. The method of claim 9 wherein each frame member has substantially the same dimensions as said polygonal shapes.

11. The method of claim 10 wherein one wall component is positioned within said at least one said frame member.

* * * * *